United States Patent [19]

Payelian et al.

[11] Patent Number: 4,772,892

[45] Date of Patent: Sep. 20, 1988

[54] TWO-AXIS GIMBAL

[75] Inventors: John Payelian, Hudson, N.H.; Edward J. Jeye, Holliston, Mass.

[73] Assignee: Raytheon Company, Lexington, Mass.

[21] Appl. No.: 670,231

[22] Filed: Nov. 13, 1984

[51] Int. Cl.[4] ..... H01Q 3/00; H01Q 3/12

[52] U.S. Cl. ..... 343/765; 343/766; 343/761

[58] Field of Search ..... 343/757, 761, 758, 763, 343/765, 766, 781 CA, 705, 754; 244/3.14, 3.16, 3.19, 3.2, 3.21

[56] References Cited

U.S. PATENT DOCUMENTS 4,070,678 1/1978 Smedes ..... 343/757 E

*Primary Examiner*—Theodore M. Blum
*Assistant Examiner*—Gregory C. Issing
*Attorney, Agent, or Firm*—Philip J. McFarland

[57] ABSTRACT

A gimbal arrangement for supporting an antenna element steerable in pitch and yaw is shown to include a generally spherical bearing supporting such element, such bearing having a slot formed therein and aligned with the pitch axis to engage a pin affixed to the antenna element and a pitch and a yaw cam assembly independently actuable to steer the antenna element in pitch and yaw.

1 Claim, 4 Drawing Sheets

TWO-AXIS GIMBAL

BACKGROUND OF THE INVENTION

This invention pertains generally to radar guidance systems and particularly to an improved gimbal for controlling the scanning of an antenna in such a system.

It has recently become feasible to use a radar guidance system operating at a frequency in the millimeter wavelength band in a terminally guided "smart" projectile. It is necessary, of course, that any such system have the capability to search for a desired target and then to track such target. To effect a search and then to track, it is highly desirable that the transmitted beam of the radar guidance system be steerable, meaning that the antenna of such system be mounted of a gimbal. Unfortunately, however, there is no known design of a gimbal that is volumetrically small enough and rugged enough to be used in a "smart" projectile.

SUMMARY OF THE INVENTION

With this background of the invention in mind it is therefore a primary object of this invention to provide an improved gimbal for use in a radar guidance system.

This and other objects of this invention are generally attained by providing a Cassegrainian antenna arrangement wherein the hyperboloidal subreflector is affixed to the inside of a radome and the paraboloidal reflector is gimballed in accordance with this invention so that such reflector may be moved in yaw and pitch as required to search for, or to track, a target. The gimbal here contemplated comprises a hollow spherical bearing centered at the second focus of the hyperboloidal subreflector to support the paraboloidal reflector. A slot is formed in the outer surface of the hollow spherical bearing, such slot being aligned with either the yaw or pitch axis of the antenna to accept a pin projecting from the paraboloidal reflector so that rotation of that reflector is prevented, but the orientation of that reflector with respect to the hollow spherical bearing may be changed. Any desired movement, within angular limits of +30° in yaw and pitch, of the paraboloidal reflector is effected by rotation of two orthogonally disposed cams contacting orthogonally disposed cam followers projecting out of the back side of the paraboloidal reflector. Each one of the two orthogonally disposed cams is directly attached to the rotor of a drive motor. Finally, the hollow spherical bearing is supported on a waveguide having an open end facing the hyperboloidal reflector.

BRIEF DESCRIPTION OF THE DRAWINGS

For a more complete understanding of this invention, reference is now made to the drawings in which.

DESCRIPTION OF THE PREFERRED EMBODIMENT

Figure 1:
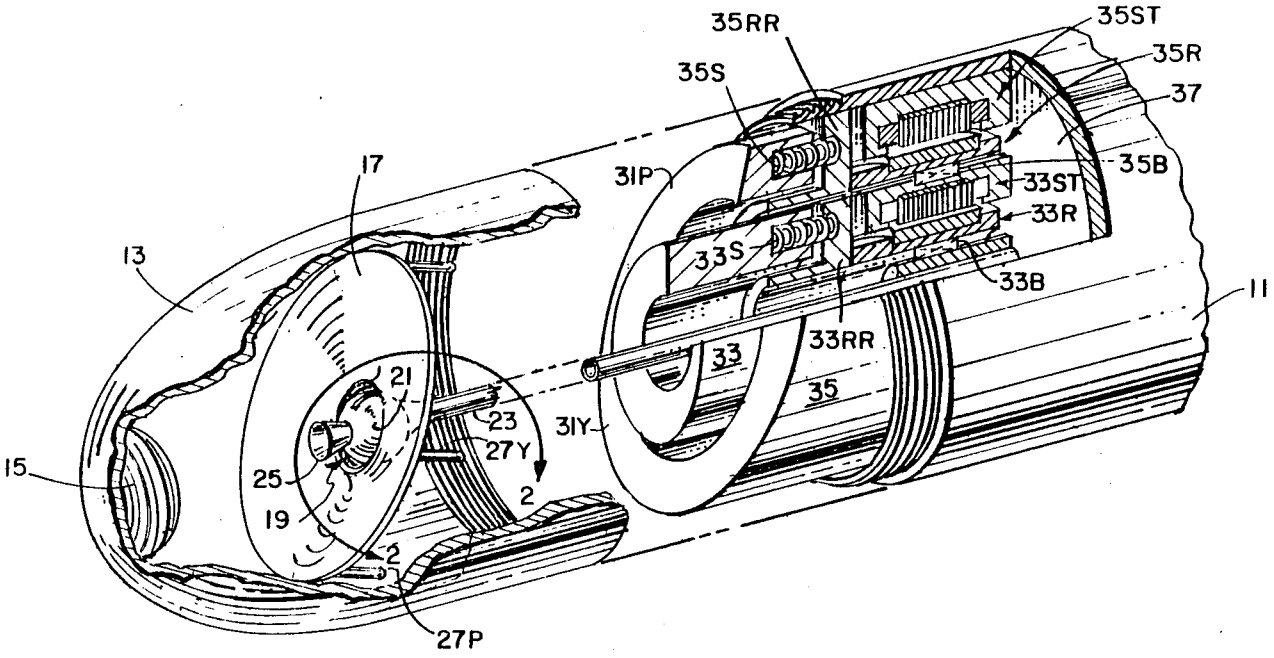
FIG. 1 is an isometric view, exploded, simplified and partially cut away, showing the arrangement of the elements of the contemplated gimbal in a projectile.
Figure 2:
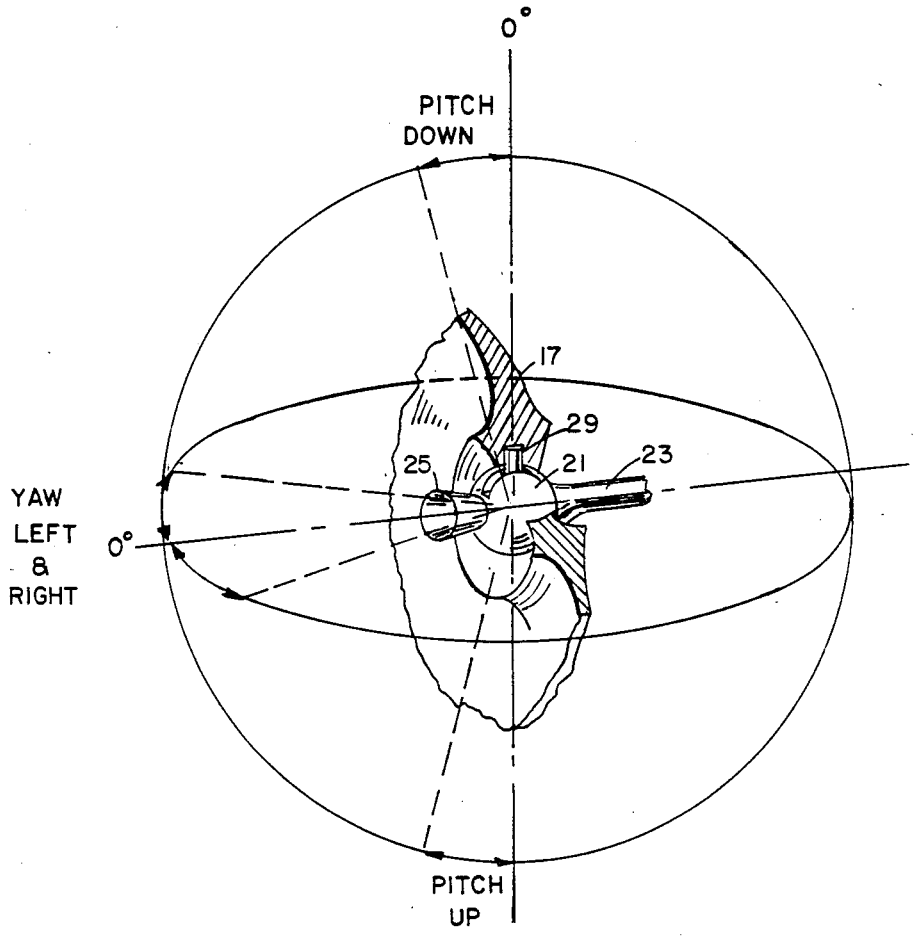
FIG. 2 is a sketch showing how a reflector is mounted on a spherical (or universal) bearing as in FIG. 1 so that such reflector may be deflected independently in yaw and pitch.

Referring now to FIG. 1 it may be seen that a Cassegrainian antenna and gimbal arrangement (not numbered) according to this invention is disposed in the forward end of a "smart" projectile 11. A radome 13 is threadably connected to the "smart" projectile 11. A hyperboloidal subreflector 15 is affixed in any convenient manner, as by cementing, to the inside of the radome 13. A paraboloidal reflector 17 is disposed on a spherical bearing assembly 19, both of which are described in detail hereinafter. Suffice it to say here that the spherical bearing assembly 19 comprises a hollow, generally spherical, member 21 supported on a waveguide 23 that in turn is supported centrally of the "smart" projectile 11 in any convenient manner and connected to a transmitter/receiver (not shown). A horn 25 is affixed to the generally spherical member 21. A pair of cam followers 27P and a pair of cam followers 27Y (only one of such pair being visible in FIG. 1) are attached in any convenient manner to the paraboloidal reflector 17. The pair of cam followers 27P is aligned along the pitch axis of the "smart" projectile 11 and the pair of cam followers 27Y is aligned along the yaw axis of the "smart" projectile 11. As shown in FIG. 2, to effect such alignment a slot (not numbered) is machined in the outer surface of the generally spherical member 21 to accommodate a pin 29 (see FIGS. 2, 3A–3C) affixed to the paraboloidal reflector 17 in any convenient manner.

The cam followers 27Y bear on a cam 31Y and the cam followers 27P bear on a cam 31P (as shown more clearly in FIGS. 3A–3C and 4A–4C). The cam 31Y is one end surface of a hollow circular cylindrical element 33 (hereinafter referred to as cam element 33), such end surface being sloped (as shown more clearly in FIGS. 3A–3C) at an angle equal to the complement of the yaw scan angle with respect to the longitudinal axis of the cam element 33. Similarly, the cam 31P is one end surface of a hollow circular cylindrical element 35 (hereinafter referred to as cam element 35), such end surface being sloped (as shown more clearly in FIGS. 4A–4C) at an angle equal to the complement of the pitch scan angle with respect to the longitudinal axis of the cam element 35. It will be noted that the waveguide 23, the cam element 33 and the cam element 35 are dimensioned so that waveguide 23 fits inside cam element 33 and cam element 33 fits inside cam element 35 so that the longitudinal axes of the three are coincident and the cam elements 33, 35 may be rotated independently. Further, it will be noted that, when the paraboloidal reflector 17 is in its center, i.e. undeflected position, the high points of the cams 31P and 31Y are displaced one from the other by 90° (compare FIGS. 3B and 4B).

The second end of the cam element 33 is formed to accept a plurality of springs (one of which, spring 33S, is shown) arranged at equally spaced points around such second end. The free end of each of such springs is fitted into a complementary retaining hole in an inner retaining ring 33RR that in turn is affixed in any convenient way to the rotor (shown generally at 33R) of a D.C. motor (not numbered) for controlling the yaw angle of the paraboloidal reflector 17. The rotor 33R is supported on bearings 33B and the stator 33ST is supported on a bulkhead 37.

The cam 31P is maintained in position in a manner similar to that just described. Thus, a plurality of springs (one of which is indicated at 35S) is positioned between cam element 35 and an outer retaining ring 35RR that is affixed to the rotor 35R of a D.C. motor (not numbered) for controlling the pit position of the paraboloidal reflector 17. The rotor 35R is supported on bearings 35B mounted on the outside of the stator 33ST and the stator 35ST is affixed to the bulkhead 37.

It will now be evident to one of skill in the art that: (a) the cams 31P and 31Y may be rotated independently of one another, ultimately to control the position of the paraboloidal reflector 17 in pitch and yaw; and (b) the springs 33S and 35S may be chosen so that the cams 31P and 31Y are forced into contact with the cam followers 27P and 27Y regardless of the rotational positions of such cams.

Figure 3A:
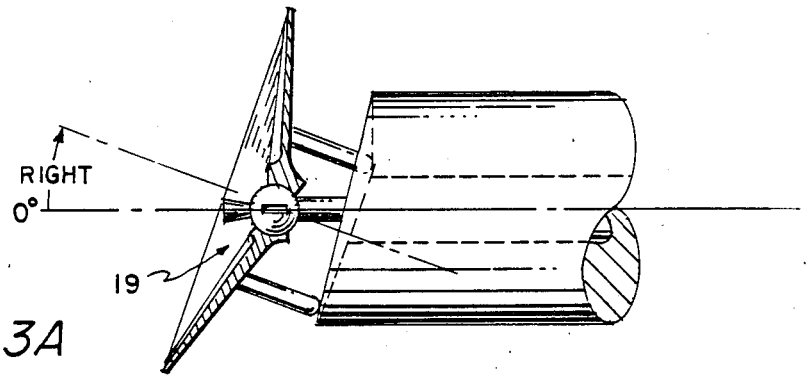
FIGS. 3A–3C and FIGS. 4A–4C are sketches showing how pitch and yaw are effected.
Figure 3B:
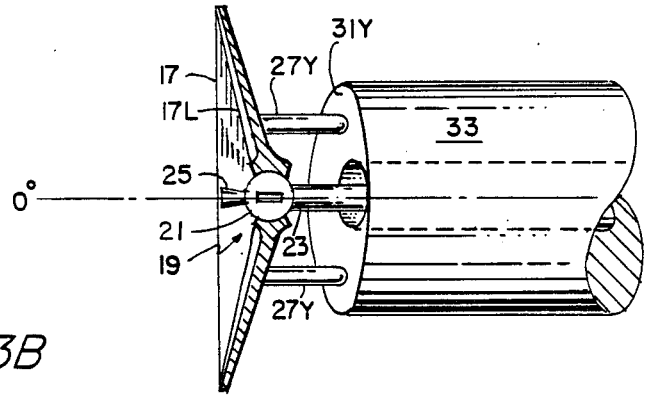
Figure 3C:
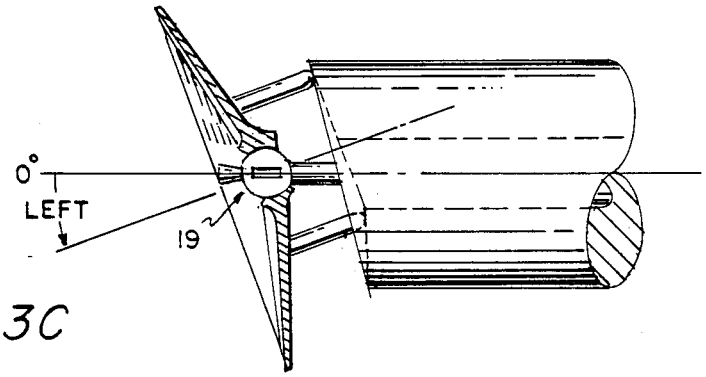
Figure 4A:
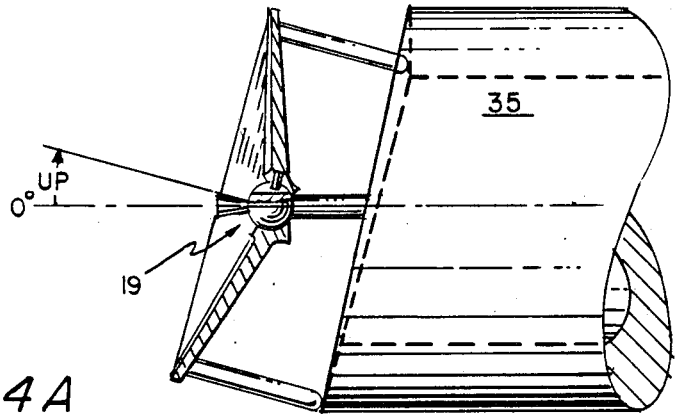
Figure 4B:
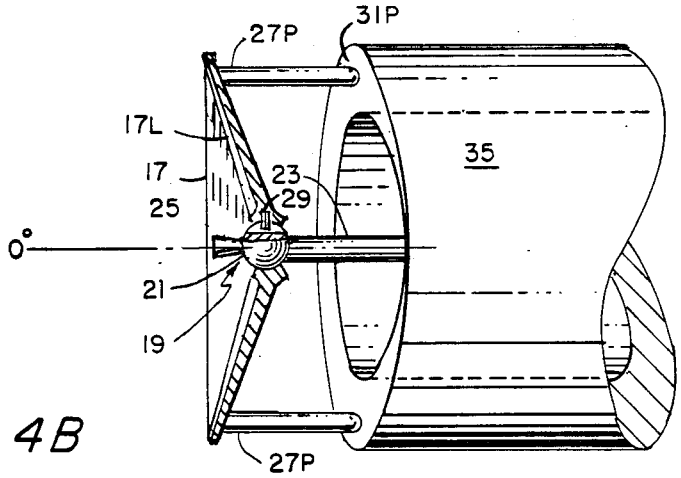
Figure 4C:
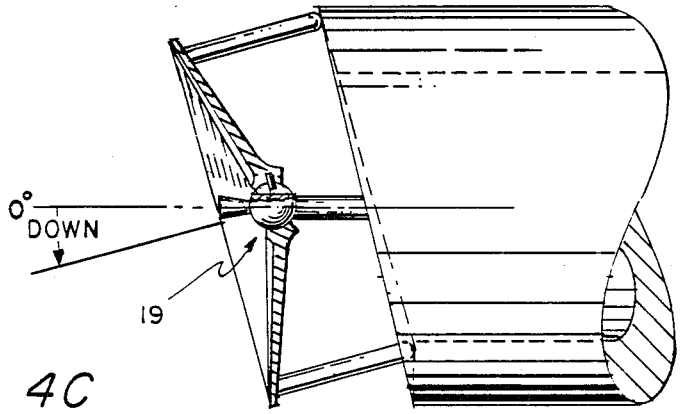

It will now be appreciated by those of skill in the art that it is necessary to maintain coincidence between the focal point of the paraboloidal reflector and one of the focal points of the hyperboloidal reflector in a Cassegrainian antenna. When there is no deflection of the paraboloidal reflector 17 (as shown in FIGS. 3B and 4B) the requisite coincidence is attained; however, as the yaw or pitch angle of paraboloidal reflector 17 is increased, the focal point of the paraboloidal reflector 17 moves away from the focal point of the hyperboloidal reflector. Such movement then introduces comatic aberration with the result that the degree of collimation of the beam (not shown) degrades as the deflection angle increases.

It is known in the art of antenna design that comatic aberration in a Cassegrainian antenna is at a minimum when the distance between the foci of the hyperboloidal reflector and the distance from the focus to the vertex of the paraboloidal reflector are maximized. Here, however, one focus of the hyperboloidal reflector 15 (FIG. 1) is fixed at the phase center of the horn 25 (FIG. 1) and the distance between the horn 25 and the hyperboloidal reflector 15 is fixed, thereby limiting the distances required for minimizing comatic aberration. It is also known, however, that the shape of the paraboloidal reflector may be "spoiled" so that the amount of comatic aberration may be made to be less related to deflection of the paraboloidal reflector. Thus, here, as shown most clearly in FIGS. 3A, 3B, 3C, 4A, 4B, 4C, a layer 17L of a dielectric material (here Rexolite, which is basically a polystyrene material manufactured by Brandywine Fibre Products, Wilmington, Del. 19801) is deposited on the paraboloidal reflector 17. The thickness of the layer 17L is tapered from the central portion of the paraboloidal reflector 17 toward the outside portion. A moment's thought will make it clear that layer 17L is effective to decrease collimation of the beam (not shown) in space when there is no deflection of the paraboloidal reflector 17 but also, when such reflector is deflected, to decrease comatic aberration.

Having described a preferred embodiment of the invention, it will now be apparent to one of skill in the art that other embodiments incorporating this concept may be used. It is felt, therefore, that this invention should not be restricted to the disclosed embodiment, but rather should be limited only by the spirit and scope of the appended claims.

What is claimed is:

1. In an antenna system utilizing a paraboloidal reflector independently steerable with respect to pitch and yaw axes, the improvement comprising:

(a) a substantially spherical bearing having a slot formed on the outside of such bearing in alignment with a pitch axis or a yaw axis;

(b) a pin affixed to the paraboloidal reflector and mating with the slot;

(c) a first pair of cam followers affixed to, and projecting from, the rear of the paraboloidal reflector, such first pair being aligned with the yaw axis;

(d) a second pair of cam followers affixed to, and projecting from, the rear of the paraboloidal reflector, such second pair being aligned with the pitch axis and being spaced from the center of such reflector at a different distance than the first pair;

(e) a yaw and pitch drive motor concentrically disposed with respect to each other, each having a rotor and a stator;

(f) a yaw cam element driven by the rotor of the yaw motor and engaging the first pair of cam followers and a pitch cam element engaging the second pair of cam followers, such yaw and pitch cam elements being concentrically disposed with respect to each other and including a circular cylindrical element having the end engaging a pair of cam followers cut at an angle equal to the complement of the maximum angle of deflection with respect to the longitudinal axis of the corresponding circular cylindrical element.

* * * * *